United States Patent [19]

Pella

[11] Patent Number: 4,715,252

[45] Date of Patent: Dec. 29, 1987

[54] VALVE WRENCH

[75] Inventor: Amy Pella, Pascagoula, Miss.

[73] Assignee: Chevron Research Co., San Francisco, Calif.

[21] Appl. No.: 885,900

[22] Filed: Jul. 15, 1986

[51] Int. Cl.[4] ..... B25B 13/48

[52] U.S. Cl. ..... 81/176.1; 81/119

[58] Field of Search ..... 81/119, 488, 186, 120, 81/176.1, 176.15, 176.2; 7/138, 166

[56] References Cited

U.S. PATENT DOCUMENTS

| | | | |
|---|---|---|---|
| 2,086,722 | 7/1937 | Matuella | 81/119 |
| 2,539,262 | 10/1946 | Moore | 81/119 |
| 2,682,189 | 6/1954 | Bergman | 81/119 |

*Primary Examiner*—Frederick R. Schmidt
*Assistant Examiner*—Bradley I. Vaught
*Attorney, Agent, or Firm*—S. R. La Paglia; E. J. Keeling; E. A. Schaal

[57] ABSTRACT

A device for safely rotating the wheel of a large or hard-to-turn valve is disclosed. The wrench comprises an elongated handle, and a wheel grip. The wheel grip further consists of a rim grip and a spoke grip. The rim grip extends upwardly (when viewed from above) around the bottom of the rim of a valve wheel. The spoke grip extends downwardly, first around the rim of the wheel, then inwardly, so as to grasp the spoke of the valve wheel.

4 Claims, 6 Drawing Figures

VALVE WRENCH

BACKGROUND OF THE INVENTION

The present invention applies generally to the field of wrenches. In particular, the present invention provides an easy and safe means for turning otherwise difficult to turn valves with a circular spoked hand wheel.

In the petroleum and chemical industries it is frequently necessary to turn large valves. These valves can be extremely difficult to turn, and may become increasingly so with age. Wrenches can be attached to the valve wheel to provide greater leverage to rotate the wheel.

Various methods of aiding this process have been proposed. For example, U.S. Pat. No. 2,086,722 describes a wrench in which three projections extend from the main body of the wrench so as to engage the rim of the valve wheel. U.S. Pat. No. 2,539,262 describes a wrench that alternately wraps two members over and under the wheel rim in order to provide additional leverage. U.S. Pat. No. 2,682,189 provides a wrench that does so in an improved manner over '262.

The above-described devices have several inherent disadvantages. First, they are not is self-supporting upon being slipped onto the valve, so they are likely to cause injury when the wrench is released. Second, they do not derive support from both the spoke and the wheel rim, thereby more evenly distributing the load so as to minimize the chance of breakage. Further, they do not effectively eliminate the chance of slippage along the rim by positively and necessarily engaging the spoke of a valve wheel.

SUMMARY OF THE INVENTION

The present invention provides workers with a safe means of turning large and/or stiff valves. A metallic handle is connected to a valve wheel-clamping device. The clamping device consists of a rim-grasping element and a spoke-grasping element. When viewed from above, the wheel-grasping element extends upward and outward from the handle so as to hook over and bear against a valve wheel. The spoke-grasping element extends downward and outward from the handle, so as to hook under and bear against the wheel rim, and having a terminus which extends upward and inward toward the handle, so as to hook over and grasp the spoke of a valve wheel.

By engaging the spoke with the device described above, the wrench becomes self-supporting so as to prevent injury if the wrench is inadvertently released while being used. Further, by positively engaging the spoke of the wheel, the probability of slippage along the wheel rim is reduced. The engagement of the spoke provides the additional advantage of distributing the load applied to the valve in an even manner so as to reduce the chance of wheel breakage and, therefore, further reducing the chance of injury to the user.

DETAILED DESCRIPTION OF THE INVENTION

Figure 1:
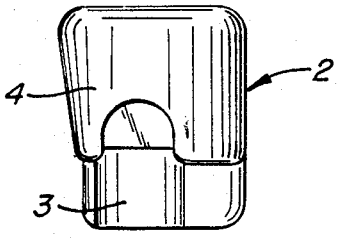
FIG. 1 is an end view of the wrench.

Referring to FIGS. 1, 2, 3, and 4, it can be seen that the preferred embodiment of the invention consists of an elongated handle 1 integrally constructed with a wheel-grasping device 2 at the end of the handle. The wheel-grasping device further includes a rim-gripping means 3 and a spoke-grasping means 4. The rim-gripping means extends outwardly, and upwardly from the handle (when viewed from above) eventually forming a curved surface with a radius of curvature which corresponds roughly to the radius of curvature of the rim 5 of the valve wheel 6 for which the user intends the wrench. The rim-grasping device can be broad and even contain teeth on its inner surface so as to create an effective grip on the rim of the wheel.

The spoke-gripping means 4 is adjacent to the rim grip. The spoke-gripping means extends first outwardly (in a direction opposite that of the rim-gripping means) and downwardly from the handle 1. The spoke-gripping means extends back upwardly in a radius of curvature greater than that of the rim of the wheel. After passing the expected midpoint of the rim, the spoke-gripping means curves back, inwardly, so as to grasp the spoke 7 of the valve wheel 6 at a radius of curvature sufficient to wrap comfortably around the spoke of the wheel for which use is intended. The surfaces of this device are broad and simultaneously wrap around the wheel rim to a point at approximately the top of the rim. They may contain further teeth to reduce any possibility of slippage.

It should be noted that various size wheel grips can be used with a single handle by constructing the handle such that the wheel grip slips into the end of the handle.

Figure 5:
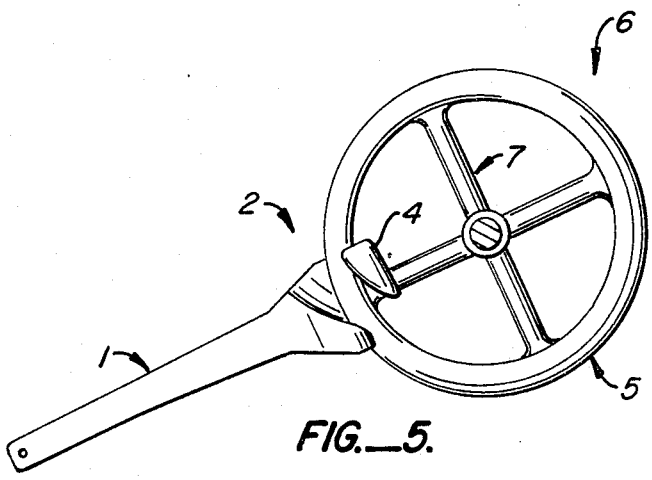
FIG. 5 is a top view of the wrench in operation.
Figure 2:
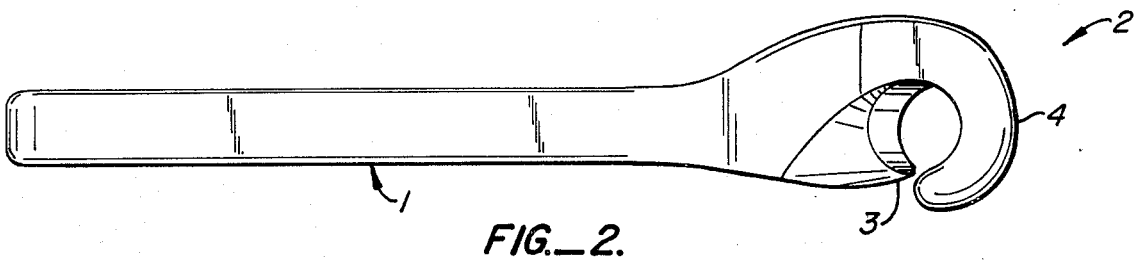
FIG. 2 is a side view of the wrench.
Figure 3:
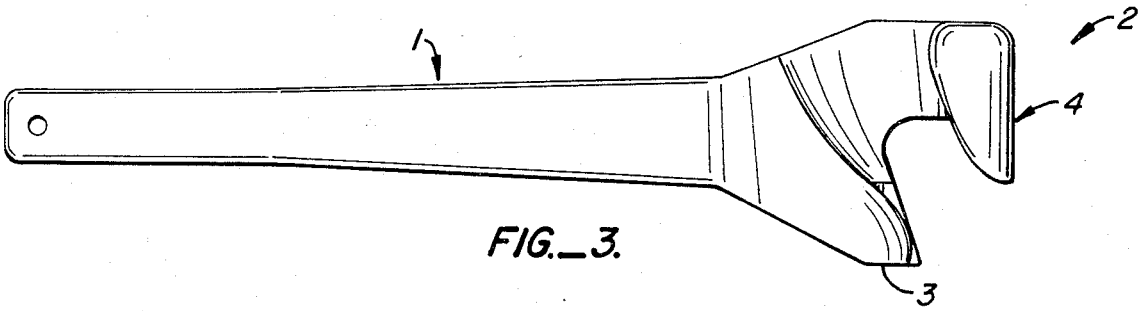
FIG. 3 is a top view of the wrench.
Figure 4:
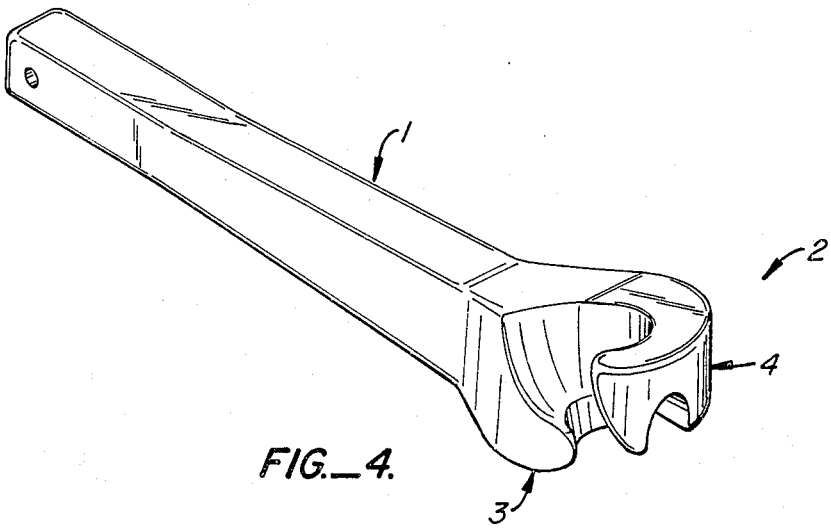
FIG. 4 is a perspective view of the wrench.
Figure 6:
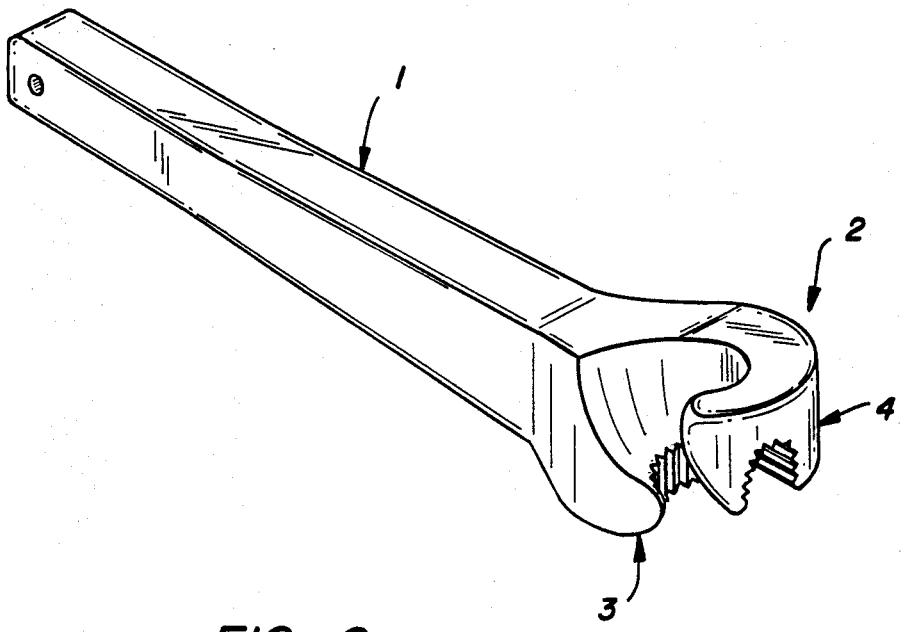
FIG. 6 is a perspective view of an embodiment of the wrench having teeth on the rim grip and the spoke grip of said wrench.

As can be seen from FIG. 5, by having the rim and spoke-grasping devices arranged in this manner the wrench can be applied to a valve wheel and will be self-supporting. This feature reduces the possibility of injury to an operator in the event that the wrench is released. In addition, by grasping the spoke of the wheel, the possibility that the tool might slip is effectively reduced to zero. In addition, by distributing the load applied to the tool over both the spoke and the rim so the probability of breaking the valve wheel is reduced.

The device can be constructed of any one of several materials, depending on the use of the particular device, and may be constructed of a variety of metals familiar to one skilled in the art. For example, it could be constructed of steel, aluminum, or any variety of alloys, such as magnesium-aluminum.

It is intended that the above description be interpreted as illustrative and not restrictive. Therefore, the scope of the invention should be determined with reference to the following claims.

What is claimed is:

1. A valve wrench comprising:

(a) a handle;

(b) a wheel grasping device comprising:

(i) a rim grip at the end of said handle extending from said handle at a radius of curvature which approximates the radius of curvature of a rim of a valve wheel; and (ii) a spoke grip adjacent to said rim grip, said spoke grip extending in a direction opposite said rim grip, then extending at a radius of curvature greater than that of said rim, then extending at a radius of curvature which approximates the radius of curvature of a valve wheel spoke whereby the load applied to said valve wheel is distributed to both the spoke and rim.

2. A valve wrench as recited in claim 1 further comprising:

teeth on said rim grip; and teeth on said spoke grip, whereby a valve wheel can be turned without slipping.

3. A valve wrench as recited in claim 1 wherein said handle and said wheel grasping device are constructed of steel.

4. A valve wrench as recited in claim 1 wherein said handle and said wheel grasping device are constructed of an aluminum-magnesium alloy.

* * * * *